US005292192A

United States Patent [19]

Lautenschläger

[11] Patent Number: 5,292,192

[45] Date of Patent: Mar. 8, 1994

[54] GUIDE RAIL FOR ROLLER DRAWER GUIDES

[75] Inventor: Horst Lautenschläger, Reinheim, Fed. Rep. of Germany

[73] Assignee: MEPLA-Werke Lautenschläger GmbH & Co. KG, Fed. Rep. of Germany

[21] Appl. No.: 971,864

[22] PCT Filed: Apr. 8, 1992

[86] PCT No.: PCT/EP92/00792

§ 371 Date: Jan. 8, 1993

§ 102(e) Date: Jan. 8, 1993

[87] PCT Pub. No.: WO92/21268

PCT Pub. Date: Dec. 10, 1992

[30] Foreign Application Priority Data

Jun. 6, 1991 [DE] Fed. Rep. of Germany ..... 4118567

[51] Int. Cl.[5] ..... A47B 88/00

[52] U.S. Cl. ..... 312/334.12; 312/334.18; 312/334.21; 384/19

[58] Field of Search ..... 312/330.1, 334.1, 334.7, 312/334.12, 334.18, 334.21; 384/19

[56] References Cited

U.S. PATENT DOCUMENTS

| | | | |
|---|---|---|---|
| 4,173,380 | 11/1979 | Dupree | 312/330.1 |
| 4,508,394 | 4/1985 | Rock | 312/334.7 |
| 4,615,572 | 10/1986 | Nelson | 384/19 X |
| 4,639,145 | 1/1987 | Lautenschlager | 384/19 |
| 4,799,802 | 1/1989 | Lautenschlager | 384/19 |
| 5,039,181 | 8/1991 | Lautenschlager | 312/343 X |

*Primary Examiner*—Kenneth J. Dorner
*Assistant Examiner*—Nancy Mulcare

[57] ABSTRACT

Profiled rail of metal plate with an approximately U-shaped cross-section provided as a guide rail (10) for roller drawer guides in articles of furniture which may be screwed with its web surface (14) onto the support wall of a cupboard carcass. The running roller of the profiled running rail which is to be mounted on the associated withdrawable furniture portion, for instance a drawer, runs on the strip-shaped limb sections (16; 18) projecting from the web surface (14). At its front end at the exterior of the carcass the profiled rail has a substantially flat surfaced fastening flange (20) as an extension of the web surface (14) from which the pivot pin (22) for the running roller (24) running on the running rail projects.

The fastening flange (20) is bent with respect to the plane of the web surface (14) or the profiled rail about an axis extending substantially transverse to the longitudinal axis of the profiled rail so that when the profiled rail is placed against the associated carcass support wall (12) only the end of the profiled track in the interior of the carcass and the vertical front edge of the fastening flange (20) engage the support wall (12) while there is a small gap in the intervening regions between the support wall (12) and the flat sides directed towards it of the web surface (14) and the fastening flange (20). When tightening the fastening screw pressing the guide rail (10) against the support wall (12) the guide rail is elastically so deformed that the gap which is initially present disappears. The guide rail is thus under a biassing force which stiffens it.

2 Claims, 1 Drawing Sheet

GUIDE RAIL FOR ROLLER DRAWER GUIDES

Figure 1:
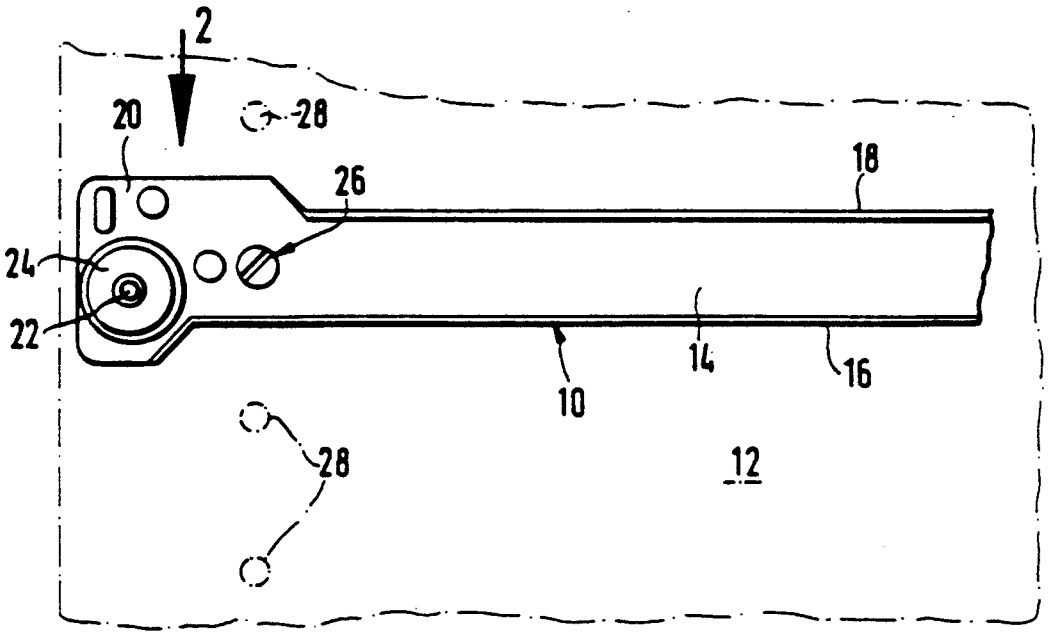

The invention relates to a profiled bar of metal plate with an approximately U-shaped cross-section provided as a guide rail for roller drawer guides in articles of furniture which may be screwed with its web surface onto the support wall of the associated cupboard carcass and on whose strip-shaped limb sections projecting from the web surface runs the running roller of the associated profiled running track, which is to be mounted on the withdrawable furniture portion, and which at its front end at the exterior of the carcass carries a substantially flat surfaced fastening flange as an extension of the web surface from which the pivot pin for the fixed running roller running on the running rail also projects.

Roller drawer guides of the type in question have been successful to an increasing extent in recent years in furniture construction for the slidable mounting of drawers and other withdrawable furniture in the associated furniture carcass since they ensure easy running of the furniture portions which are to be withdrawn from the cupboard body and may be loaded with the required weights provided that the guide and running rails are profiled of metal plate of sufficient material thickness. A sufficient load bearing ability of such drawer guides is assumed to be present if on the one hand a drawer which is mounted with the roller drawer guide in question in a cupboard body and is loaded with a predetermined weight has survived a predetermined number of withdrawing/pushing in cycles without damage in tests and if further more the drawer sinks at the front opening side only by a small amount as a consequence of elastic deformation of the profiled rails when loaded with a predetermined maximum weight and in the fully withdrawn state. These conditions are fulfilled by the drawer guides currently offered on the market, but the material thickness of the metal plate used for the profiling of the guide rail currently generally has a lower threshold of about 2 mm. Tests have now shown that when manufacturing the guide rail from metal plates of smaller thickness the required number of withdrawing-/pushing in cycles may also be achieved but, however, the guide rail is then—particularly if it is secured at its front end not in the region of the fastening flange but offset somewhat into the interior of the cupboard—too flexible in order to prevent sinking of the fully loaded drawer in the fully withdrawn state by more than the acceptable amount. Fastening of the front end of guide rails in a support which is inwardly displaced with respect to the fastening flange is, however, frequently effected if the support wall of the cupboard carcass is in any event provided with the usual rows of bores for receiving compartment base carriers. However, the fastening flange carrying the running roller of the guide rail then projects beyond the actual fastening point and the aforementioned sinking of the drawer occurs in the withdrawn state.

It is the object of the invention so to develop the guide rail of the roller drawer guides in question that it has the required load bearing ability in the installed state even when it is profiled from metal plate of lesser material thickness.

Starting from a guide rail of the type referred to above this object is solved in accordance with the invention if the fastening flange is bent with respect to the plane of the web surface of the profiled rail about an axis extending substantially transverse to the longitudinal direction of the profiled rail such that when the profiled rail is placed against the associated carcass support wall initially only the end of the profiled rail in the interior of the carcass and the vertical front edge of the fastening flange engage the support wall whilst in the intervening regions there is a small gap between the support wall and the associated flat sides of the web surface and of the fastening flange. When fastening the guide rail to the support wall of the cupboard carcass the guide rail is then drawn into engagement with the support wall by appropriate tightening of the fastening screw whereby it deforms elastically and is thus under internal prestressing which stiffens the guide rail against elastic deformation of the fastening flange with respect to the remainder of the guide rail. The result of this is thus that the guide rail can be manufactured from plate materials with smaller material thicknesses (e.g. 1.2 mm) without an installed roller drawer guide with such a guide rail sinking impermissibly in the withdrawn state under the prescribed test conditions.

The bending axis extending transverse to the longitudinal direction of the guide rail is preferably provided approximately in the region in which the upper strip shaped limb section, which is provided as a track for the running roller of the running rail, of the guide rail ends.

Figure 2:
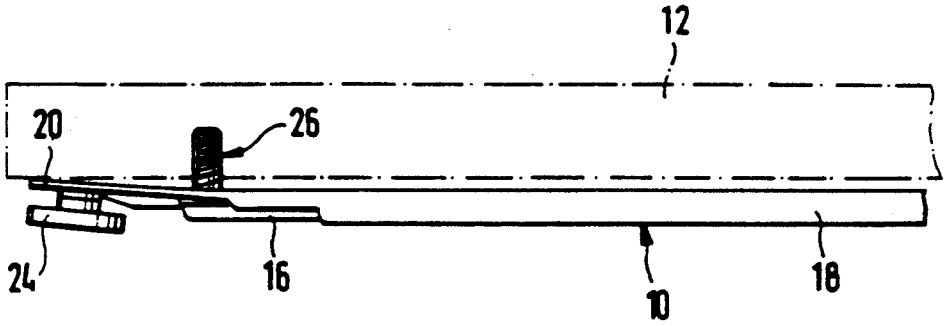

The invention will be described in more detail in the following description of an exemplary embodiment in conjunction with the drawings, in which:

FIG. 1 is a side view of the front end at the exterior of the carcass of a guide rail constructed in with the invention of a roller drawer guide; and FIG. 2 is a view of the front end of the guide rail seen in the direction of the arrow 2 in FIG. 1.

The drawings show the front end of a guide rail 10 which is to be secured to the side wall 12—indicated in the drawing in chain dotted lines—of a cupboard carcass. The guide rail 10 has the shape of a profiled bar of U-shape cross-section which has been bent or rolled from metal plate and from whose web surface 14, which is to be secured in engagement with the side wall, a respective lower and upper strip-shaped limb section 16, 18 projects at right angles, between which the running roller of the—associated running rail not shown—secured to the withdrawable furniture portion is received. Depending on the position of the centre of gravity of the withdrawable furniture portion the running rail running roller bears against the lower or upper limb section 16 or 18 and rolls along the respective loaded limb section during withdrawal or rolling motion.

At the front end—shown on the left in the drawings—of the guide rail the web surface merges into a substantially flat surfaced enlarged fastening flange 20 from which a pivot pin 22 projecting at right angles for the mounting of the guide rail running roller 24 projects, which for its part engages between the strip-shaped limb sections of the running rail, which is not shown. Different bores or stamped apertures are provided in the fastening flange 20 and in the adjoining transition region of the fastening flange into the web surface 14 of the guide rail 10 through which the threaded shaft of a fastening screw 26 may be screwed into a fastening bore 28 in the side wall 12.

In the illustrated case one bore 28 of a row of bores provided vertically above one another at uniform spacings provided in the side wall 12 is to be used as the fastening bore. Such rows of bores are in any event provided in the side walls of many cupboards and serve to receive base carriers for intermediate bases or to secure the fastening flanges of mounting plates for hinges with which the door wings of cupboard doors are pivotally fastened to the cupboard carcass. These rows of bores are provided at a spacing from the front end edge of the cupboard side wall 12, whereby the fastening flange 20, which carries the running roller 24, of the guide rail 10 is situated in front of the row of bores and thus also in front of the front fastening screw 26 which secures the guide rail to the side wall. When the withdrawable furniture portion is fully withdrawn and its weight thus bears on the running roller 24 of the guide track with a relatively large lever arm, there is the danger that the fastening flange 20, which is not stiffened by the limb section 16, 18, can elastically deform if the thickness of the plate material of the guide rail is not sufficiently large in order to prevent impermissibly large deformation.

Since, on the other hand, thinner plate materials would clearly be suitable for manufacturing sufficiently supportive guide rails as regards load bearing ability merely from the point of view of strength and such guide rails manufactured from thinner plate material would then offer a significant cost advantage by comparison with guide rails with a greater material thickness, the fastening flange of the guide rail 10 is bent in the manner which may be seen in FIG. 2 relative to the web surface 14 of the guide rail 10 such that when the guide rail engages the side wall 12 only the vertical free front edge of the fastening flange 20 and the rear end of the guide rail engage the side wall whilst in the region between them there is a gap between the web surface 14 and the side wall 12 which is largest in the region of the bending axis. In the illustrated case the bending axis is provided approximately in the transition region between the fastening flange 20 and the web surface 14 of the guide rail 10 in which the bore for the fastening screw 26 is also provided. When the guide rail 10 is now screwed by means of the fastening screw into firm engagement with the side wall 12, the fastening flange bends back elastically relative to the web surface, whereby a biassing force is produced in the transition region between the fastening flange and the guide rail which inhibits elastic deformation of the fastening flange as a result of the weight of a withdrawn furniture portion.

The result of this is that guide rails can be manufactured from thinner plate materials which fulfil the load requirements placed on them in a similar manner to the guide rails which are now common of plate materials of greater thickness. The elastic biassing force produced in the transition region between the fastening flange 20 and the web surface 14 acts also as security against unscrewing of the fastening screw 26 as a consequence of vibrations or the like.

It will be clear that modifications and developments of the described exemplary embodiment may be realised within the scope of the invention. Thus the position of the bending axis can also be altered—in dependence on the fastening position which is provided—and instead of a defined bending edge the bending of the fastening flange relative to the web surface can also be realised in a strip-shaped bending region. Of importance is that, in the unfastened state during mounting onto the associated side wall, the guide rail 10, which initially engages the cupboard side wall only in the front and rear end region, is drawn by the fastening screw into engagement with the side wall and is thus elastically deformed so that biassing forces are produced in the guide rail which prevent a furniture portion which is fully pulled out sinking downwardly at the front under a high loading.

I claim:

1. An article of furniture having a furniture carcass and a profiled rail of metal plate with an approximately U-shaped cross-section provided as a guide rail for roller drawer guides in said article of furniture, having a web surface which is screwed onto the support wall of the furniture carcass of said article of furniture and having strip-shaped limb sections projecting from the web surface and running a roller of the profiled rail on a withdrawable furniture portion and wherein the front end of said profile rail at the exterior of the furniture carcass and carriers a substantially flat surfaced fastening flange as an extension of the web surface from which a pivot pin for the fixed running roller which is running on the profiled rail also projects, characterised in that the fastening flange is bent with respect to the plane of the web surface of the profiled rail about an axis extending substantially transverse to the longitudinal direction of the profiled rail such that when the profiled rail is placed against the said support wall of the furniture carcass, wherein initially, only an end of the profiled rail inside the furniture carcass and a vertical front edge of the fastening flange engage the support wall whilst in the intervening regions there is a small gap between the support wall and the associated flat sides of the web surface and of the fastening flange.

2. Profiled rail as claimed in claim 1, characterised in that a bending axis, which extends transversely to the longitudinal direction of the profiled rail, is provided approximately in the region of the profiled rail in which the upper, strip-shaped limb section of the profiled rail, which is provided as a track for the running roller of the associated rail, ends.

* * * * *